US005827136A

United States Patent [19]

Halter et al.

[11] Patent Number: 5,827,136

[45] Date of Patent: Oct. 27, 1998

[54] BASKETBALL BACKBOARD AND HOOP ASSEMBLY INCLUDING AN ENLARGED SECONDARY TRAINING RIM

[75] Inventors: Jeffrey T. Halter; Michael A. Moore, both of Cincinnati, Ohio

[73] Assignee: Hasbro, Inc., Pawtucket, R.I.

[21] Appl. No.: 941,956

[22] Filed: Oct. 1, 1997

[51] Int. Cl.[6] ..... A63B 63/08; A63B 69/00

[52] U.S. Cl. ..... 473/447; 473/448; 473/481; 473/485; 473/487

[58] Field of Search ..... 473/447, 448, 473/472, 479, 480, 481, 482, 485, 487, 488, 100, 101; 273/398, 400, 401, 402

[56] References Cited

U.S. PATENT DOCUMENTS

| | | | |
|---|---|---|---|
| 868,950 | 10/1907 | Vasey . | |
| 2,278,616 | 4/1942 | Kettering | 273/1.5 |
| 2,918,283 | 12/1959 | Marschalik | 473/448 |
| 3,163,419 | 12/1964 | Lemelson | 273/105 |
| 3,421,764 | 1/1969 | Smith et al. | 273/105 |
| 3,603,588 | 9/1971 | Ebstein | 473/485 |
| 3,692,072 | 9/1972 | Kohls | 141/391 |
| 3,788,642 | 1/1974 | Matras et al. | 473/481 |
| 3,888,486 | 6/1975 | Sutter et al. | 273/105 R |
| 3,948,516 | 4/1976 | Jones, Sr. | 273/1.5 R |
| 4,036,494 | 7/1977 | Hayes | 273/1.5 R |
| 4,266,764 | 5/1981 | Collins | 272/3 |
| 4,828,270 | 5/1989 | Chiang | 273/401 |
| 5,069,441 | 12/1991 | Fang | 473/485 |
| 5,096,191 | 3/1992 | Fang | 473/485 |
| 5,244,213 | 9/1993 | Armell | 273/400 |
| 5,358,255 | 10/1994 | Jolson | 273/400 |
| 5,409,211 | 4/1995 | Adamek | 273/1.5 A |
| 5,536,003 | 7/1996 | Brenner | 473/481 |
| 5,558,323 | 9/1996 | Lo Faso, Sr. | 473/448 |
| 5,597,158 | 1/1997 | Spikes | 473/485 |

*Primary Examiner*—William H. Grieb
*Attorney, Agent, or Firm*—Kurt R. Benson

[57] ABSTRACT

A children's basketball backboard and hoop assembly includes a backboard, and a hoop having a rim which is pivotably attached to the backboard, and a net attached to the rim. The assembly further includes an enlarged secondary training rim pivotably attached to the backboard for movement between an operative position wherein the secondary rim is located above the hoop rim in substantially parallel relation to the hoop rim, and a storage position generally parallel to the backboard. The hoop rim is pivotably attached to the backboard for movement between an operative position wherein the rim extends substantially perpendicular to the backboard and a storage position wherein the rim is positioned in closely spaced parallel relation to the backboard. When the secondary training rim is moved to the storage position it is received within a recess extending along an upper peripheral edge of the backboard. The basketball backboard and hoop assembly also includes one set of straps for releasably securing the backboard to a door, and a second set of straps for releasably securing the backboard to a vertical post. The enlarged secondary hoop is intended to be used by relatively young children to guide stray balls downwardly into the hoop, thereby increasing the chances of making a basket.

20 Claims, 5 Drawing Sheets

BASKETBALL BACKBOARD AND HOOP ASSEMBLY INCLUDING AN ENLARGED SECONDARY TRAINING RIM

BACKGROUND AND SUMMARY OF THE INVENTION

The instant invention relates to children's sporting games, and more particularly to a children's basketball backboard and hoop assembly including an enlarged training rim positioned above the hoop. The enlarged training rim is intended to be used by young children to guide or funnel the ball downwardly into the hoop, thereby increasing the chances of the younger children making a basket.

Basketball backboard and hoop assemblies including a secondary rim structure have heretofore been known in the art. In this regard, the U.S. Pat. Nos. to Marschalk No. 2,918,283; Collins No. 4,266,764; Fang No. 5,069,441; Fang No. 5,096,191; Brenner No. 5,536,003 and Lofaso No. 5,558,323 represent the closest prior art to the subject invention of which the Applicants are aware. More specifically, the U.S. Patent to Marschalk discloses basketball practice device comprising a backboard, a regulation size hoop, and a reduced diameter ring positioned above the hoop. The reduced diameter ring above the hoop is utilized during practice to improve accuracy so that during game play, the basket psychologically seems to be bigger to the person who practiced with the smaller ring installed. The Patent to Collins discloses a basketball backboard including two hoops spaced vertically apart, one above the other. The backboard rotates during use to provide amusement. The U.S. Pat. No. to Fang No. 5,069,441 discloses a basketball training assembly including a backboard having a plurality of concentric hoops of different sizes arranged within a common plane. The U.S. Pat. No. to Fang No. 5,096,191 discloses a similar basketball training assembly including a backboard with a plurality of different sized hoops arranged in vertically spaced relation. The smallest hoop is positioned at the highest elevation, and the larger diameter hoops are arranged below the smaller hoop to collect missed shots. The Patent to Brenner discloses a basketball hoop structure having vertically spaced hoops with the upper hoop having a larger rim than the lower hoop. Finally, the patent to Lofaso discloses a basketball hoop with an auxiliary ring attached to the hoop, wherein the auxiliary ring extends in a plane which is at an acute angle to the horizontal plane of the hoop rim. While the above-noted devices are effective for their intended purpose, there is an ongoing consumer desire for new and improved children's products and sports practice devices.

In this regard, the instant invention provides a children's basketball backboard and hoop assembly including a backboard, a primary rim which is pivotably attached to the backboard, a net attached to the primary rim, and an enlarged secondary training rim pivotably attached to the backboard for movement between an operative position wherein the secondary rim is located above the primary rim in substantially parallel relation to the primary rim, and a storage position generally parallel to the backboard. The primary rim is pivotably attached to the backboard for movement between an operative position wherein the rim extends substantially perpendicular to the backboard and a storage position wherein the rim is positioned in closely spaced parallel relation to the backboard. When the secondary training rim is moved to the storage position it is received within a recess extending along an upper peripheral edge of the backboard. The basketball backboard and hoop assembly also includes a first set of straps for releasably securing the backboard to a door, and a second set of straps for releasably securing the backboard to a vertical post. The enlarged secondary rim is intended to be used by young children to guide or funnel balls downwardly into the hoop, thereby increasing the chances of making a basket.

Accordingly, among the objects of the instant invention are: the provision of a children's basketball backboard and hoop assembly that includes an enlarged secondary training rim which is positioned above the hoop rim to capture stray shots, and to funnel the ball into the hoop, thereby increasing the chances of the younger children making a basket; the provision of such a backboard and hoop assembly wherein the enlarged training rim is pivotably mounted to the backboard for movement between an operative position above the hoop and a storage position wherein the training rim is substantially parallel to the backboard; the provision of such a backboard and hoop assembly wherein the training rim is received within a recess in the backboard when moved to the storage position; and the provision of such a basketball backboard and hoop assembly wherein the primary rim is also pivotably attached to the backboard for movement between an operative position and a storage position.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
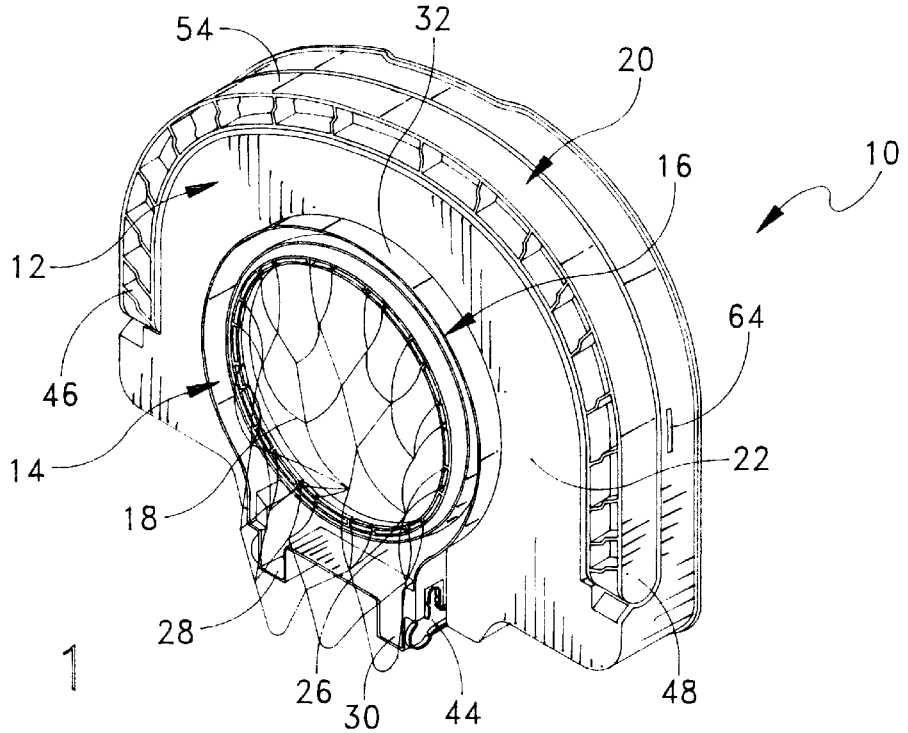
FIG. 1 is a perspective view of the basketball backboard and hoop assembly of the instant invention with the hoop and secondary rim pivoted upwardly into their storage positions.
Figure 2:
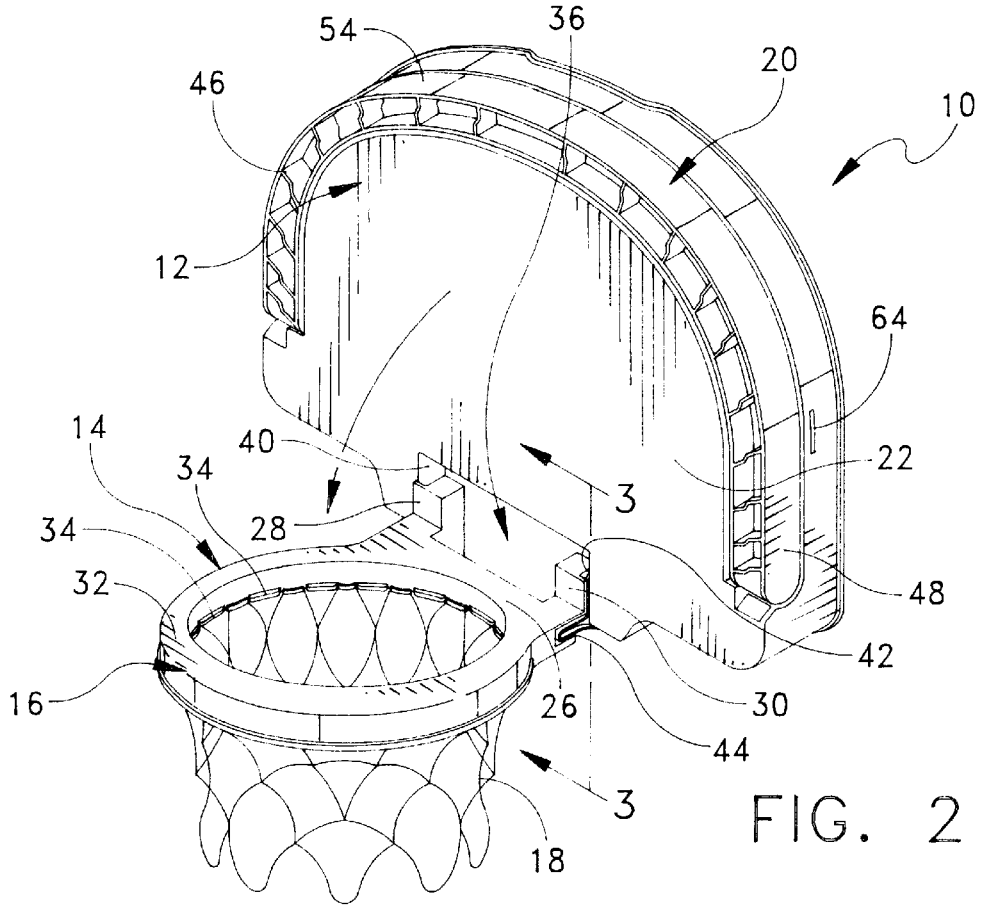
FIG. 2 is another perspective view thereof with the hoop pivoted into the operative position.

Referring now to the drawings, the basketball backboard and hoop assembly of the instant is illustrated and generally indicated at 10 in FIGS. 1, 2, 7 and 8. As will hereinafter be more fully described, the instant basketball backboard and hoop assembly includes a secondary training rim which increases the chances of a young child making a basket.

More specifically, the basketball backboard and hoop assembly 10 comprises a backboard generally indicated at 12, and a hoop generally indicated at 14 including a primary rim 16 which is pivotably attached to the backboard 12, and a net 18 attached to the primary rim 16. The assembly 10 further comprises an enlarged secondary training rim generally indicated at 20 which is pivotably attached to the backboard 12 for movement between an operative position wherein the secondary rim 20 is located above the primary rim 16 in substantially parallel relation to the primary rim 16, and a storage position generally parallel to the backboard 12. Unless otherwise stated herein, it is to be assumed that each of the elements described herein are preferably molded from a plastic material, or alternatively formed from other suitable child safe materials.

Figure 3:
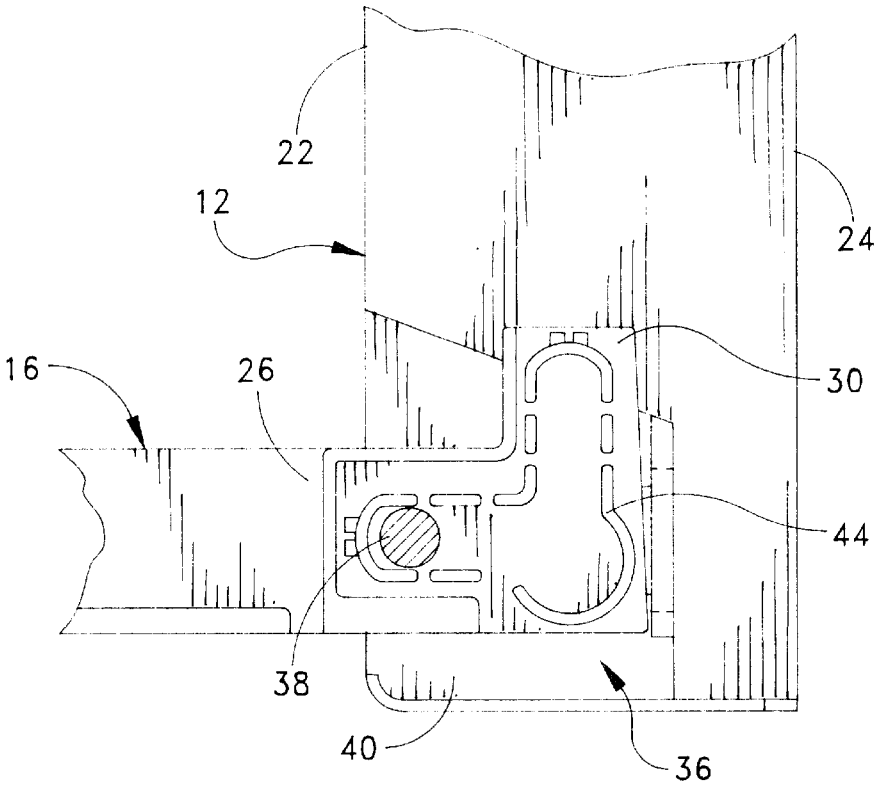
FIG. 3 is a cross-sectional view of the pivot arrangement in the lowered position as taken along line 3—3 of FIG. 2.
Figure 4:
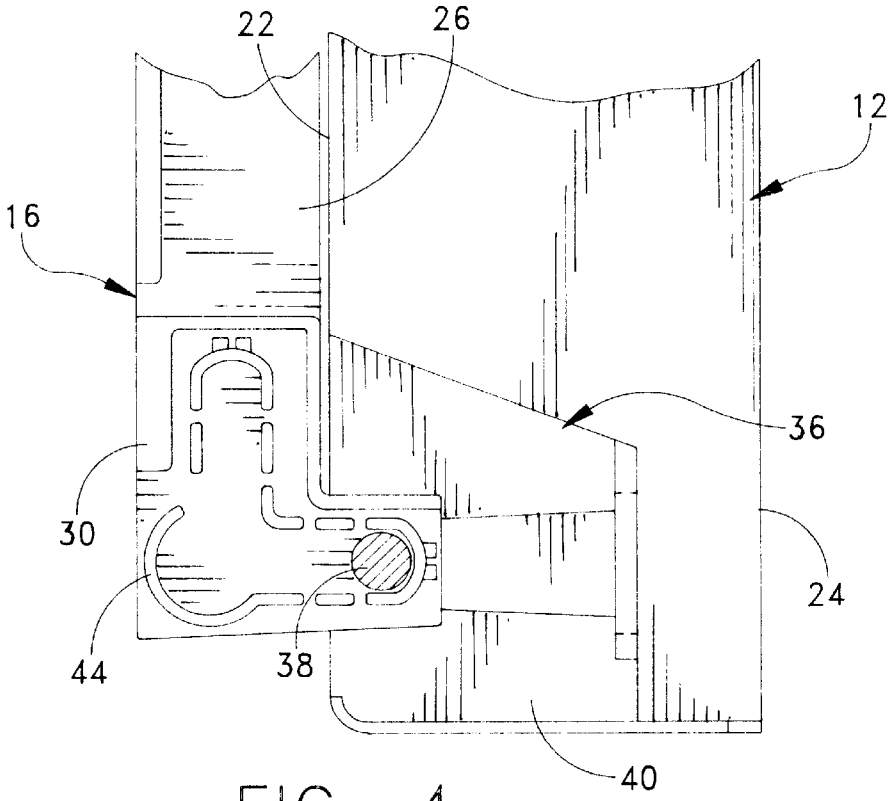
FIG. 4 is another cross-sectional view of the pivot arrangement in the upper storage position.

The backboard 12 is conventional in shape and includes front and rear surfaces 22, 24 respectively. The front surface 22 is intended to form a surface for bouncing a basketball back toward the player. The hoop rim 16 includes a body portion 26, two spaced L-shaped leg portions 28, 30 extending rearwardly from the body portion 26, and a rim portion 32 extending forwardly from the body portion 26. The net 18 is fabricated from conventional nylon mesh, and is attached to tabs 34 on the inner surface of the rim portion 32. The L-shaped leg portions 28, 30 are pivotably mounted within a rectangular recess 36 formed in the bottom front edge of the backboard 12. In this regard, the recess 36 includes two pivot pins 38 which extend inwardly from the side edges 40, 42 respectively, of the recess 36, and the outer side edges of the leg portions 28, 30 include an L-shaped guide channel 44 into which the pivot pins 38 are received to secure the hoop rim 16 onto the backboard 12. In use, the pivot pins 38 slidably move within the channel 44 so that the rim 16 is slidably movable between an operative position (FIGS. 2 and 3) wherein the rim 16 is positioned perpendicular to the backboard 12, and a storage position (FIGS. 1 and 4) wherein the rim 16 is positioned in closely spaced parallel relation to the front surface 22 of the backboard 12.

Figure 5:
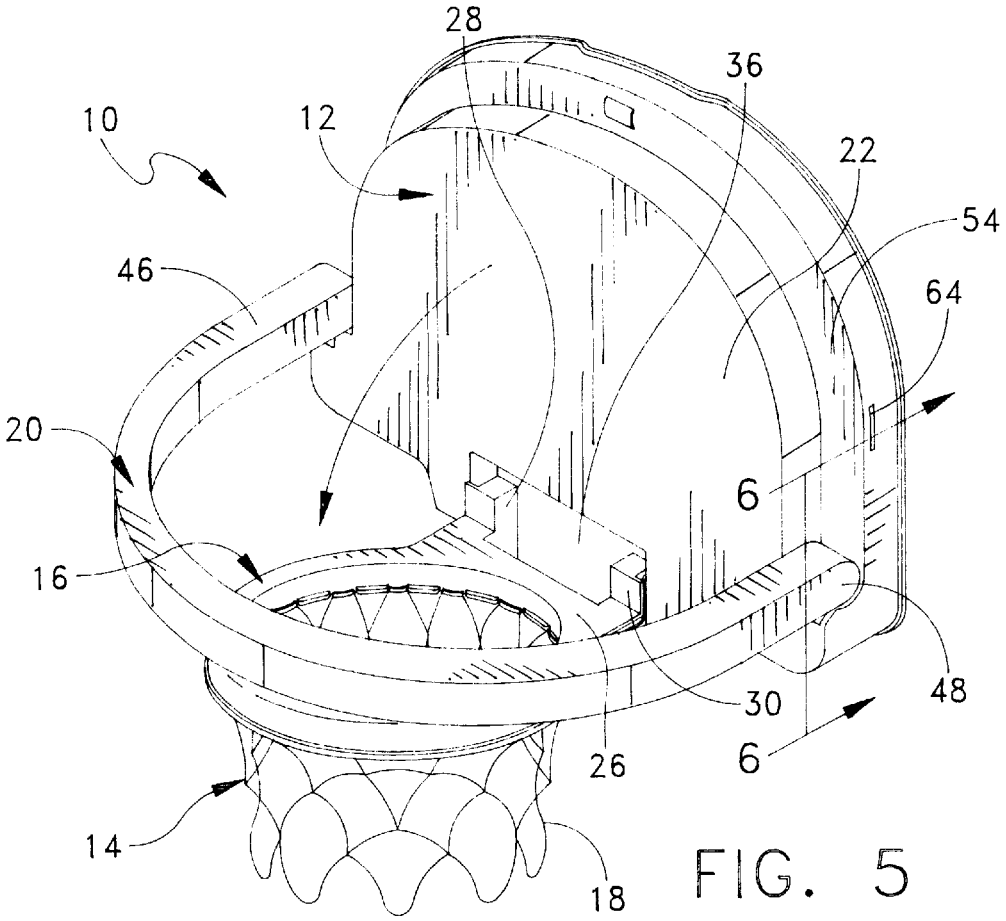
FIG. 5 is a perspective view of the basketball backboard and hoop assembly with the secondary rim pivoted downwardly into the operative position.
Figure 6:
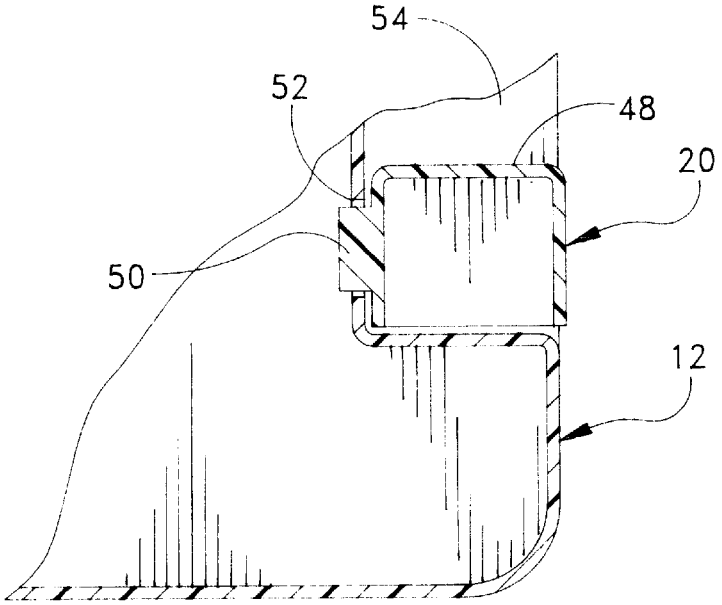
FIG. 6 is a cross-sectional view of the secondary rim pivot arrangement as taken along line 6—6 of FIG. 5.

The training rim 20 is generally U-shaped and has opposite ends 46, 48 each of which is pivotably attached to the backboard 12. Referring to FIGS. 5 and 6, each end 46, 48 of the rim 20 includes an inwardly extending pivot pin 50 which is received into a corresponding aperture 52 formed in a side edge of the backboard 12. The training rim 20 is preferably mounted within a recess 54 formed along the outer peripheral edge of the backboard 12 so that the training rim 20 is hidden within the front surface 22 of the backboard 12 when it is positioned in the storage position. In this regard, when the training rim 20 is pivoted upwardly into the storage position (FIG. 2), it merges into the front surface 22 of the backboard 12 to form a continuous flat surface with the front of the backboard 12. It is important to note that the lengthwise and widthwise dimensions of the training rim 20 are generally about 1.5 to 2 times the diameter of the rim 16 so that the training rim 20 can guide many stray balls through the hoop. In general, the space between the rim 16 and the training rim 20 should not be greater than the diameter of the ball used so that the ball does not pass between the rims 16 and 20. Although the training rim 20 is not completely circular, the rim 20 should be positioned concentrically above the rim 16 so that the spacing between the rim 16 and the training rim 20 is generally equal on all sides.

Figure 7:
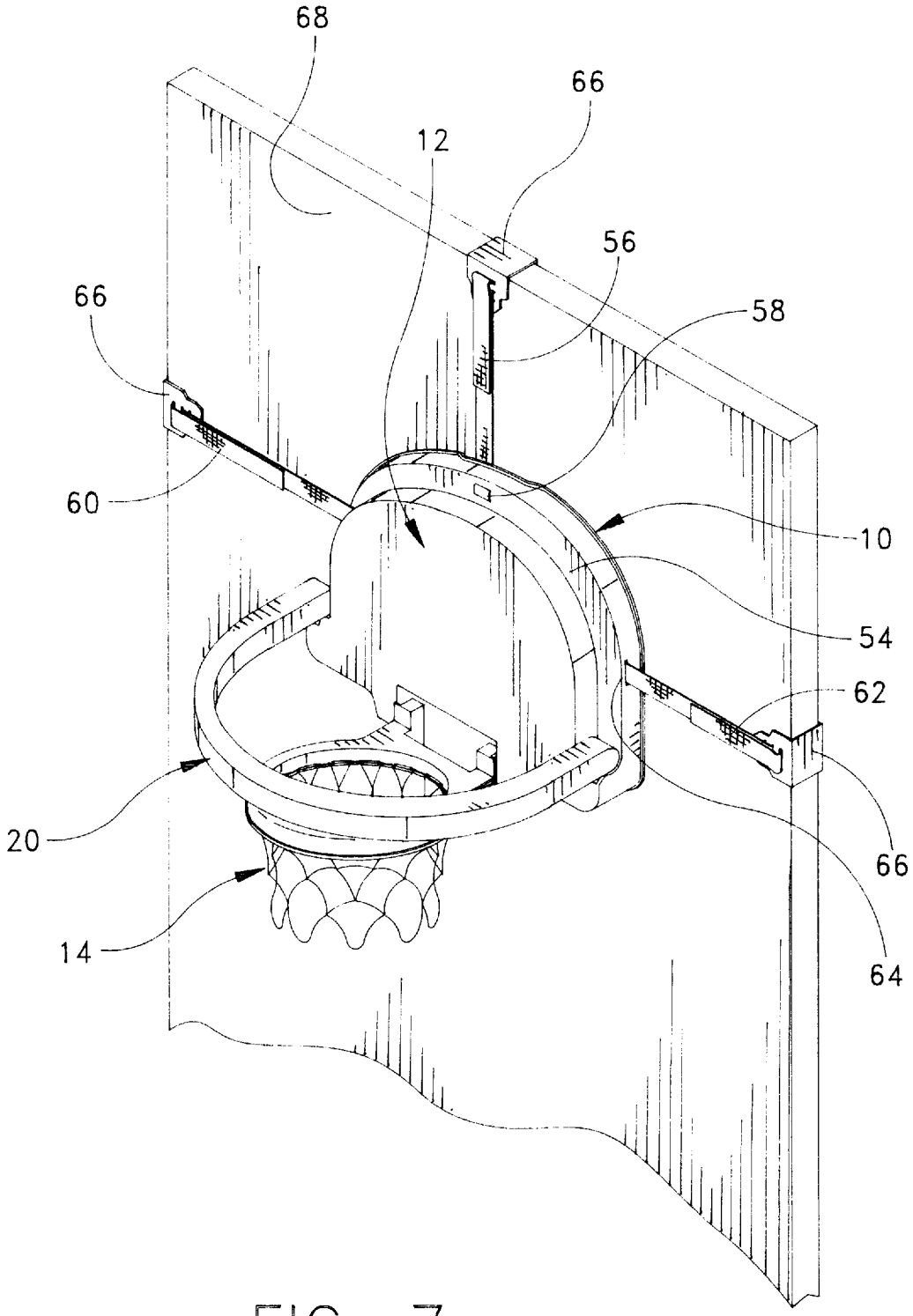
FIG. 7 is a perspective view of the basketball backboard and hoop assembly mounted on a door.

Referring to FIG. 7, the assembly 10 includes a set of nylon straps for mounting the backboard 12 to a door. A first strap 56 is received through a slot 58 in the center of the upper edge of the backboard 12, and two side straps 60, 62 respectively are received through slots 64 in the side edges of the backboard 12. Each of straps 56, 60, and 62 includes a U-shaped clip 66 which is received over the edge of a door 68 for mounting of the backboard 12 on the door.

Figure 8:
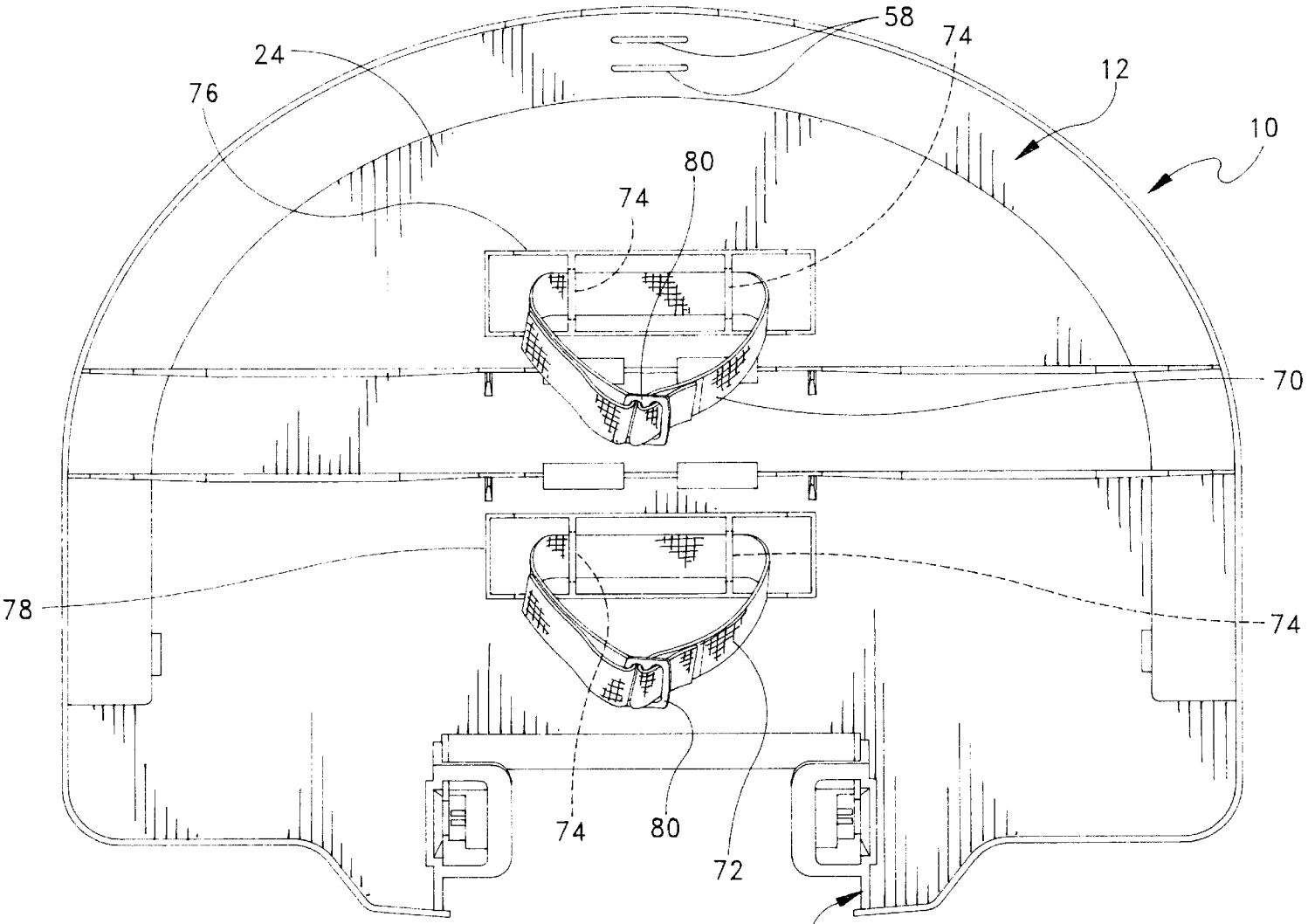
FIG. 8 is a rear view of the basketball backboard and hoop assembly showing the alternate strap means for mounting the assembly onto an upright pole member.

Referring to FIG. 8, the assembly 10 also includes a set of belt-style straps 70, 72 located on the rear surface 24 of the backboard 12 for attaching the backboard 12 to a pole (not shown). The straps 70, 72 are looped through slots 74 formed in spaced strap mounts 76, 78 which extend rearwardly from the rear surface 24 of the backboard 12. The straps 70, 72 include buckles 80 for slidably adjusting the straps 70, 72 in a conventional manner. The central portions of the strap mounts 76, 78 are curved inwardly so that they are receivable in snug facing relation with the outer surface of a cylindrical post or pole.

It can therefore be seen that the instant invention provides a unique and amusing basketball practice device for use by both younger and older children. The pivoting training rim 20 is easily positioned above the hoop 14 for use by young children to guide or funnel many stray shots downwardly through the hoop 14. As the child grows, and becomes more proficient at shooting baskets, the training rim 20 can be pivoted to the recessed storage position to completely hide the training rim 20 when not in use. Furthermore, because both the hoop 14 and the training rim 20 can pivot to storage positions parallel to the backboard 12, the entire assembly 10 can be stored in a narrow storage space, such as under a couch or behind a door. Even further still, the dual strap sets permit multiple mounting arrangements for extended enjoyment of the assembly by children of all ages. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A basketball backboard and hoop assembly comprising:

a backboard;

a hoop including a primary rim which is attached to the backboard; and an enlarged secondary rim pivotably attached to the backboard for movement between an operative position wherein the secondary rim is located above the hoop in substantially parallel relation to the primary rim, and a storage position generally parallel to the backboard, said secondary rim being operative for funneling balls downwardly into the primary rim.

2. The basketball backboard and hoop assembly of claim 1 wherein the secondary rim is received within a recess in a front surface of the backboard when the secondary rim is pivoted to the storage position.

3. The basketball backboard and hoop assembly of claim 2 wherein the recess extends along an upper peripheral edge of the backboard.

4. The basketball backboard and hoop assembly of claim 1 wherein said primary rim is pivotably attached to the backboard for movement between an operative position wherein the primary rim extends substantially perpendicular to the backboard and a storage position wherein the primary rim is positioned in closely spaced parallel relation to the backboard.

5. The basketball backboard and hoop assembly of claim 2 wherein said primary rim is pivotably attached to the backboard for movement between an operative position wherein the rim extends substantially perpendicular to the backboard and a storage position wherein the primary rim is positioned in closely spaced parallel relation to the backboard.

6. The basketball backboard and hoop assembly of claim 3 wherein said primary rim is pivotably attached to the backboard for movement between an operative position wherein the rim extends substantially perpendicular to the backboard and a storage position wherein the primary rim is positioned in closely spaced parallel relation to the backboard.

7. The basketball backboard and hoop assembly of claim 1 further comprising means for releasably securing the backboard to a door.

8. The basketball backboard and hoop assembly of claim 7 wherein said means for releasably securing comprises straps attached to predetermined locations on said backboard.

9. The basketball backboard and hoop assembly of claim 1 further comprising means for releasably securing the backboard to a vertical post.

10. The basketball backboard and hoop assembly of claim 9 wherein said means for securing said backboard comprises straps attached to a back surface of said backboard.

11. The basketball backboard and hoop assembly of claim 7 further comprising means for releasably securing the backboard to a vertical post.

12. The basketball backboard and hoop assembly of claim 2 further comprising means for releasably securing the backboard to a door.

13. The basketball backboard and hoop assembly of claim 2 further comprising means for releasably securing the backboard to a vertical post.

14. The basketball backboard and hoop assembly of claim 12 further comprising means for releasably securing the backboard to a vertical post.

15. The basketball backboard and hoop assembly of claim 3 further comprising means for releasably securing the backboard to a door.

16. The basketball backboard and hoop assembly of claim 3 further comprising means for releasably securing the backboard to a vertical post.

17. The basketball backboard and hoop assembly of claim 15 further comprising means for releasably securing the backboard to a vertical post.

18. The basketball backboard and hoop assembly of claim 4 further comprising means for releasably securing the backboard to a door.

19. The basketball backboard and hoop assembly of claim 4 further comprising means for releasably securing the backboard to a vertical post.

20. The basketball backboard and hoop assembly of claim 18 further comprising means for releasably securing the backboard to a vertical post.

* * * * *